United States Patent [19]

Niinomi et al.

[11] Patent Number: 4,649,786

[45] Date of Patent: Mar. 17, 1987

[54] ELECTRONIC MUSICAL INSTRUMENT

[75] Inventors: Naoyuki Niinomi; Kunihiko Watanabe, both of Hamamatsu, Japan

[73] Assignee: Nippon Gakki Seizo Kabushiki Kaisha, Shizuoka, Japan

[21] Appl. No.: 594,406

[22] Filed: Mar. 27, 1984

Related U.S. Application Data

[63] Continuation of Ser. No. 406,667, Aug. 9, 1982, abandoned, which is a continuation of Ser. No. 149,883, May 14, 1980, abandoned.

[30] Foreign Application Priority Data

May 19, 1979 [JP] Japan ..... 54-61873

[51] Int. Cl.[4] ..... G10H 1/02

[52] U.S. Cl. ..... 84/1.19; 84/DIG. 9; 84/1.25; 84/115; 84/345

[58] Field of Search ..... 84/1.01, 1.03, 1.24, 84/1.28, DIG. 9, DIG. 12, 115, 345, 1.25

[56] References Cited

U.S. PATENT DOCUMENTS

| | | | |
|---|---|---|---|
| 4,147,083 | 4/1979 | Woron et al. | 84/1.01 |
| 4,185,531 | 1/1980 | Oberheim et al. | 84/1.24 X |
| 4,206,676 | 6/1980 | Adachi et al. | 84/1.03 |
| 4,231,276 | 11/1980 | Ando et al. | 84/1.24 |
| 4,358,980 | 11/1982 | Imamura | 84/1.19 |
| 4,365,532 | 12/1982 | Nakada et al. | 84/1.19 |
| 4,375,776 | 3/1983 | Okamoto | 84/1.24 |

OTHER PUBLICATIONS

Oberheim, Instruction Manual for the Cassette Interface, Nov. 1978.

*Primary Examiner*—Forester W. Isen

*Attorney, Agent, or Firm*—Townsend and Townsend

[57] ABSTRACT

An electronic musical instrument comprises a plurality of keyboards each having a plurality of keys, a control circuit for controlling a manner of tone production, and a musical tone production circuit responsive to respective depressed keys of respective keyboards. The control circuit controls the musical tone production circuit in response to operation of a switch mounted on a control panel for manually selecting one of a plurality of sets of preset parameters corresponding to a kind of a musical tone to be performed. The musical tone production circuit modifies a tone specified by a depressed key in any keyboard according to the selected switch on the control panel.

20 Claims, 10 Drawing Figures

ELECTRONIC MUSICAL INSTRUMENT

CROSS REFERENCE TO RELATED CASES

This application is a continuation of U.S. Ser. No. 406,667 filed Aug. 9, 1982, now abandoned which is a continuation of Application Ser. No. 149,883 filed May 14, 1980 now abandoned.

BACKGROUND OF THE INVENTION

This invention relates to an electronic musical instrument, and more particularly an electronic musical instrument of the type that can change the color, volume, effect, etc., of a musical tone produced according to the operation of such operating members as a plurality of volume adjusting members, switches or the like which are mounted on a panel board.

A prior art electronic organs constructed such that after suitably setting a plurality of tone levers provided for each of a upper keyboard (UK), a lower keyboard (LK) and a pedal keyboard (PK) as well as volume adjusting members and switches regarding such effects as vibrato, tremolo, etc., and regarding UK/LK tone volume, balance, sustain time, the depth of reverb, etc. a desired musical composition can be performed. However, for a novice performer, it is difficult to set such a plurality of operating members to be suitable for performing such a variety of musical composition fashions as a church fashion, a jazz fashion, a pops fashion, a childrens music fashion and a classic fashion so that a considerable time is wasted before commencing a performance.

SUMMARY OF THE INVENTION

Accordingly, it is an object of this invention to provide an improved electronic musical instrument in which musical tones suitable for respective keyboards can be readily established according to the desired musical composition designated by a simple switch-operation, so as to perform readily the instrument even by a novice performer.

Still another object of this invention is to provide a novel electronic musical instrument in which unnecessary operating members are normally eliminated (or made inoperative) from the surface of a panel where a relatively unskilled performer performs.

According to this invention, these and further objects can be accomplished by providing an electronic musical instrument comprising a plurality of keyboard sections each having a plurality of keys, means for controlling a manner of tone production, and means coupled to the control means for forming tones corresponding to respective depressed keys of respective keyboard sections, the control means including a plurality of sets of preset devices in which a plurality of parameters corresponding to the kinds of a musical tones to be performed are to be set, a switch means mounted on a control panel for manually setting one of the sets of preset parameters to couple the selected set to the musical tone forming means, each tone formed by the musical tone forming means being formed by modifying a note corresponding to a depressed key according to a set of the preset parameters selected by the switch means.

BRIEF DESCRIPTION OF THE DRAWINGS

Further objects and advantages of this invention can be more fully understood from the following detailed description taken in conjunction with the accompanying drawings in which.

DESCRIPTION OF THE PREFERRED EMBODIMENTS

Figure 1:
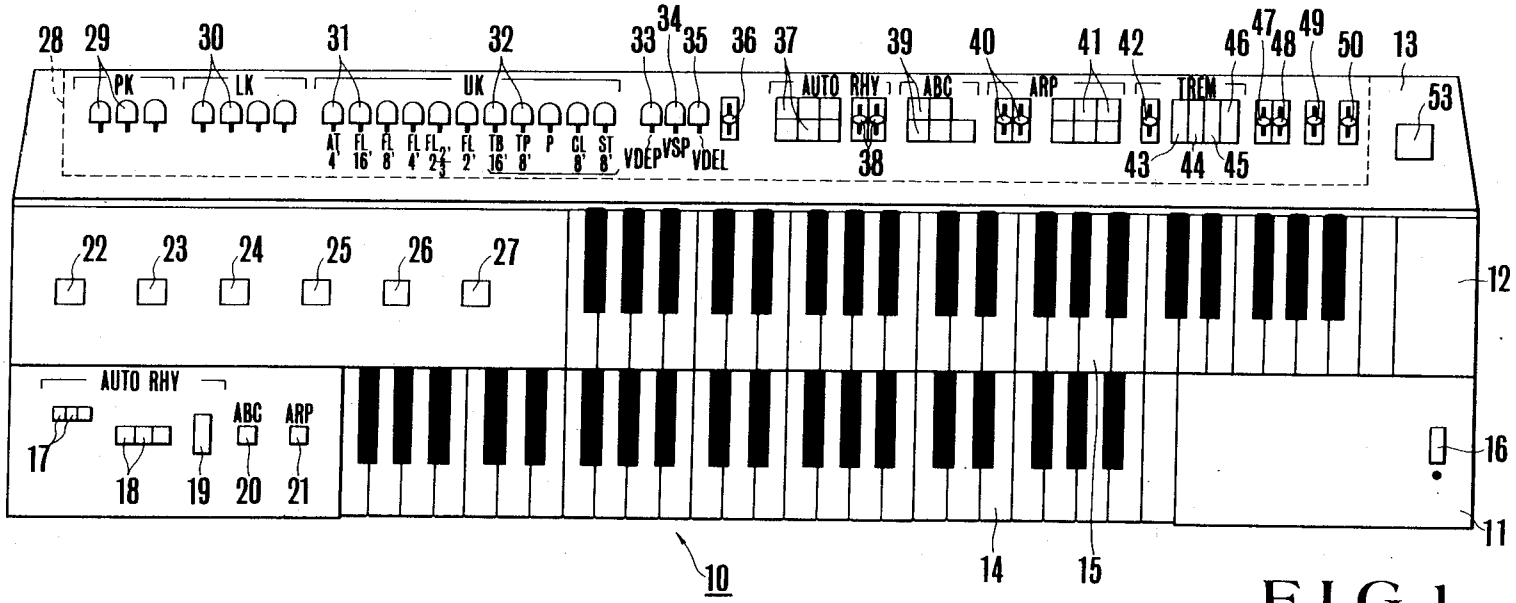
FIG. 1 is a front view showing one example of an arrangement on a panel surface of an electronic musical instrument embodying the invention.

An electronic musical instrument of this invention shown in FIG. 1 comprises a main body 10 of the musical instrument, a lower stage panel 11, a middle stage panel 12 and a upper stage panel 13.

A lower keyboard (LK) 14 is mounted on the lower stage panel 11, and a upper keyboard (UK) 15 is mounted on the middle stage panel 12. A plurality of operating members are mounted on these panels 11 and 12. More particularly, on the right hand portion of the lower stage panel 11 is mounted a power source switch 16, while on the left hand portion of the panel 11 are mounted three switches 17 for setting the tempo of an automatic rhythm performance (AUTO RHY), three rhythm selection switches 18 which select such extremely simple (varies a little) rhythm patterns as two beats, three beats, four beats etc., a switch 19 for instructing the start of the automatic rhythm performance (auto-rhythm), a switch 20 for designating a preset automatic bass/chord performance (ABC) of a simple form, and a switch 21 for designating a preset automatic arpeggio performance (auto-arpeggio) of a simple form.

Furthermore, on the left hand portion of the middle stage panel 12 are provided six musical composition fashion selection switches 22, 23, 24, 25, 26 and 27 that characterize this invention and are used to select a church fashion, a jazz fashion, a pops fashion, a mood music fashion, a children's musical fashion and a classic fashion respectively.

Figure 2:
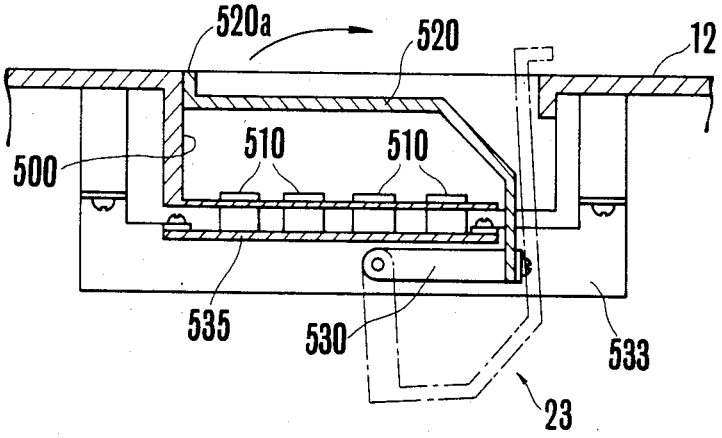
FIGS. 2 and 3 are sectional views showing different types of a blind unit shown in FIG. 1.

On the upper stage panel 12 is also provided a blind unit 28 containing a plurality of operating members 29 through 50, and a preset release switch which is not used for an ordinary performance except for a special purpose. The construction of the blind unit 28 may be of any construction so long as it can be blinded or closed so as to conceal the component elements contained therein, that is (1) of the hinged lid type, (2) sliding lid type (3) of the type having a rotatable triangular or square pillar on which switches or volume adjusting members are mounted, for example a system corresponding to type (1) shown in FIG. 2. Thus, in the blind unit 28 shown in FIG. 2, a flat panel 13 is formed with a recess 500 and a plurality of operating members and switches 510 described above are arranged on the bottom of the recess 500. The upper opening of the recess 500 is normally closed by a letter L shaped cover 520. When desired the cover 520 is pulled by a handle 520*a* to a position shown by dotted lines so as to make possible to the manipulation of the switches 510. Arms 530 and 531 are connected to two corners on the opposite side of the handle 520*a* of the cover 520, the opposite ends of the arms 530 and 531 being pivotally connected to frames or suitable supporting members 535 and 534 extending in parallel with the sheet of drawing (since the arm 531 and the supporting frame 534 are located in front of the sheet, they are not shown). In this example, the above described operating members and switches 510 are supported by a base plate 535 extending across the frames 533 and 534 on the back of the recess 500.

Figure 3:
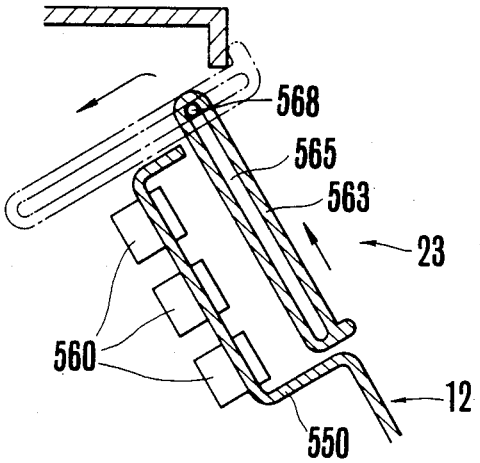

FIG. 3 illustrates one example of the type (3). In this modified blind unit 28, an inclined panel 12 is formed with a recess 550 and a plurality of operating members and switches 560 described above are disposed in the bottom of the recess. A cover 563 is provided to be guided by guide grooves 565 and 566 formed in the side surfaces of the upper opening of the recess and a pair of pins 568 and 569 extending from a panel or frame are received in these grooves (in this example, the groove 566 and the pin 569 are not shown, because they are located on the rear side of the sheet of drawing). The cover 563 is normally held in a position shown by solid lines to close the opening of the recess 550 but when desired the cover 563 is moved to a position shown by dotted lines thus permitting manipulation of the switches 560 in the bottom of the recess 550.

The operating members contained in the blind unit 28 comprise three tone volume adjusting variable resistors 29 regarding the PK (pedal keyboard), (i.e., a base 16 feet (16'), a bass 8' and a base guitar), four tone volume adjusting variable resistors 30 (i.e., a flute 8', a flute 4', a diapason 8' and a horn 8'), six tone volume adjusting variable resistors 31 regarding various flute UK tones i.e., an AT (attack) 4', a FL (flute) 16', a FL 8', a FL 4', a FL2⅔, and a FL 2'), five tone volume adjusting variable resistors 32 regarding an orchestra (OCH) system UK tones i.e., a TB (trombone) 16' a TP (trumpet) 8', a piano, a CL (Clarinet) 8', a ST (Strings) 8', a depth (VDEP) adjusting variable resistor 33 regarding the vibrato effect; a speed (VSP) adjusting variable resistor 34, a delay time (VDEL) adjusting variable resistor 35, a U(UK)/L(LK) tone volume balancing variable resistor 36, six switches 37 and two variable resistors 38 regarding an auto-rhythm (AUTO RHY), five switches 39 regarding an auto-bass/chord (ABC), two variable resistors 40 and six switches 41 concerning an auto-arpeggio (ARP), two modulation speed adjusting variable resistors 42 regarding a tremolo effect, a modulation speed (SLOW or FAST) setting variable resistor 43, a LK tone designation switch 44, an orchestra UK tone designation switch 45, a flute UK tone designation switch 46, a UK tone sustain length adjusting variable resistor 47, a PK tone sustain length adjusting variable resistor 48, a reverb depth adjusting variable resistor 49, and a master volume adjusting variable resistor 50.

When blinded or closed these operating members 29 to 50 are not accessible, and even when the blind unit is opened to permit access, their operations are invalidated unless a preset release switch 53 is closed to release the preset. More particularly in a case wherein the preset release is not made (i.e., in the case of preset) it is possible to perform an auto-rhythm, an auto-bass/-chord, or an auto-arpeggio of a simple preset type by a suitable manipulation of the operating members 17 to 21 mounted on the lower stage panel 11, and to control the musical tone based on a desired preset information by a suitable manipulation of the musical composition fashion selection switches 22 to 27 mounted on the middle stage panel 12. However, it is impossible to control the musical tone based on the control information set by the blind unit 28 so that in order to perform such control it is necessary to release the preset (i.e., transfer to the manual mode). Upon preset release, the performance of a variety of tones can be made by suitable manipulation of the operating members 29 to 50 on the upper stage 13.

Figure 4:
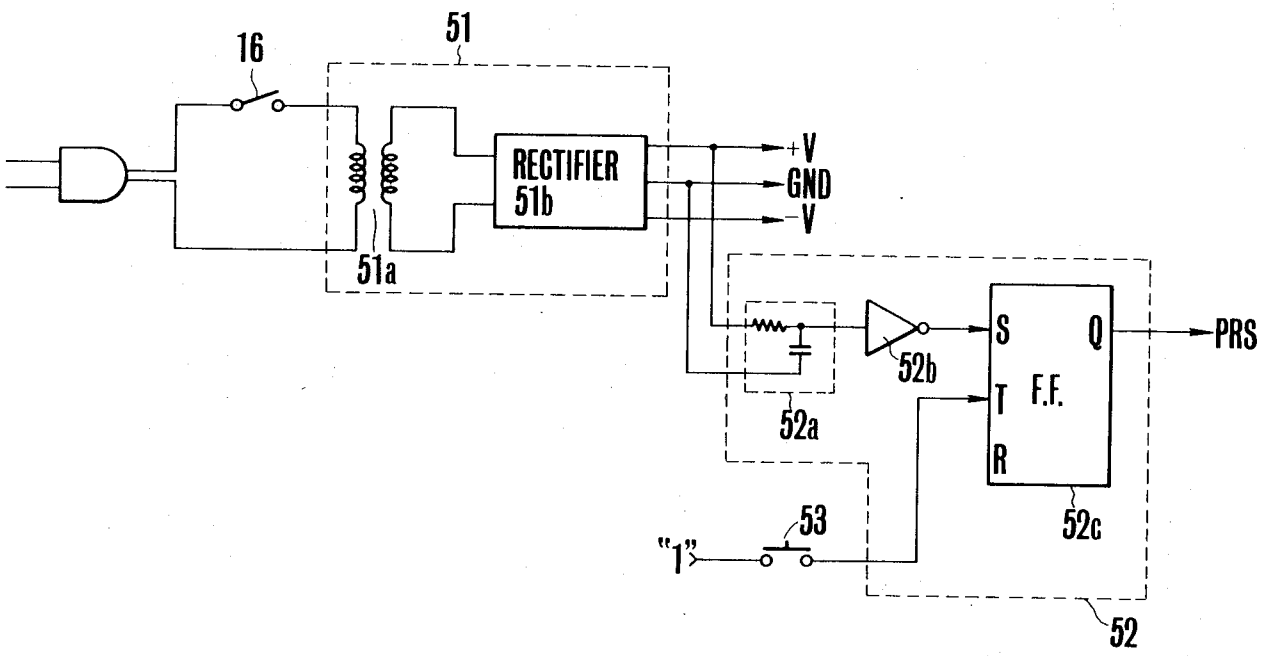
FIG. 4 is a block diagram showing the construction of a power source circuit and a preset signal forming unit utilized in the electronic musical instrument shown in FIG. 1.

FIG. 4 shows a power source circuit 51 which supplies to various component elements of the musical tone instrument voltages of ±V and a ground potential GND, and a preset signal forming unit 52. The power source circuit 51 may be a conventional one but in this example AC voltage supplied through a plug and a power source switch 16 is transformed by a transformer 51*a*, and then rectified by a rectifier 51*b* to obtain voltages ±V and the ground potential GND.

The preset signal forming unit 52 comprises an R-C integrator 52*a* with its inputs connected to receive voltage +V and the ground potential GND, an inverter 52*b* that inverts the output of the integrator 52*a*, and a flip-flop circuit 52*c* with its set terminal S connected to receive the output of the inverter 52*b*. The trigger input terminal T of the flip-flop circuit 52*c* is applied with a state signal of "1" or "0" from a preset release switch 53 in the form of a self-returning type push button. A preset signal PRS is derived out from the Q output of the flip-flop circuit 52*c*.

The preset signal PRS maintains its "1" state unless the preset release switch 53 is closed even when the power source switch 16 is closed, and when the switch 53 is operated once, the preset signal becomes "0" and this state is maintained. When the switch 53 is closed again the preset signal returns to "1" state. The preset signal PRS generated in this manner is applied to the musical tone forming and controlling unit shown in FIG. 5 for switching its operation mode. As a result, the power source switch 16 and the preset release switch 53 function as an operation mode instruction switch. More particularly, when only the power source switch 16 is closed the preset signal PRS is "1" so that the control information generated by the operating members 29 to 50 of the blind unit 28 is invalidated thus enabling control of the musical tone according to the preset information. On the other hand, when the preset release switch 53 is closed once subsequent to the closure of the power source switch 16, the preset signal PRS becomes "0" to release the preset mode whereby the musical tone control based on the control members 29 to 50 of the blind unit 28 becomes possible. When the preset release switch 53 is closed again the preset signal PRS returns to "1" as above described, so that switching is made from the manual mode to the preset mode.

The circuit for forming a musical composition fashion designation signal TSS is constructed as follows. More particularly, the state signals "1" or "0" from the musical composition fashion selection switches 22 to 27 are applied to a preferential circuit 54 which is constructed to give the priority to switch 22, for example, so as to sequentially send out state signals according to an order of switches 23, 24, 25, 26 and 27. For this reason, even when a number of the musical composition fashion selection switches 22 to 27 are closed simultaneously, the state signal "1" of only one of them having the highest priority is sent out from the preferential circuit 54.

The output signals produced by the preferential circuit 54 are supplied to an initial state setting circuit 55 which is constructed to send out a musical composition fashion designation signal TSS that designates a specific musical composition fashion at the initial state in which none of the musical composition fashion selection switch 22 to 27 is closed. Thus, the initial state setting circuit 55 comprises a NOR gate circuit 551 supplied with the state signals from switches 23, 24, 25, 26 and 27 which select such musical composition fashions as a jazz fashion, a pops fashion, a mood music fashion, a children's song fashion, and classic fashion, and an OR gate circuit 552 supplied with the output of the NOR gate circuit 551 and the state signal from the church musical composition fashion selection switch 22. When none of the selection switches 22 to 27 is closed, the NOR gate circuit 551 produces an output signal "1" so that the output signal of the OR gate circuit 552 becomes "1" whereby the musical composition fashion designation signal TSS is generated so as to designate a church musical composition fashion. When any one of the musical composition fashion selection switches 22 to 27 is closed, the bit of the musical composition fashion designation signal TSS corresponding to the closed switch becomes "1" thereby designating the musical composition fashion corresponding to the closed switch.

The musical tone forming and controlling unit controlled by the preset signal PRS and the musical composition fashion designation signal TSS comprises a UK tone generator 56 corresponding to the upper keyboard (UK) 15, a LK tone generator 61 corresponding to the lower keyboard (UK) 14, a PK tone generator 73 corresponding to a pedal keyboard PK and circuits associated therewith.

As will be described later in detail with reference to FIG. 6, the UK tone generator 56 generates a flute nontremolo musical tone signal UFNT, a flute tremolo musical tone signal UFT, an orchestra nontremolo musical tone signal UONT, and an orchestra system tremolo musical tone signal UOT. The terms "nontremolo" and "tremolo" are used herein to mean the signals intended to inpart and not impart the tremolo effect respectively. These musical tone signals UFNT, UFT, UONT and UOT are sent out respectively through resistors 57, 58, 59 and 60. The nontremolo type musical signals UFNT and UONT are mixed together by resistors 57 and 59 whereas the tremolo type musical signals UFT and UOT are mixed together by resistors 58 and 60.

Figure 7:
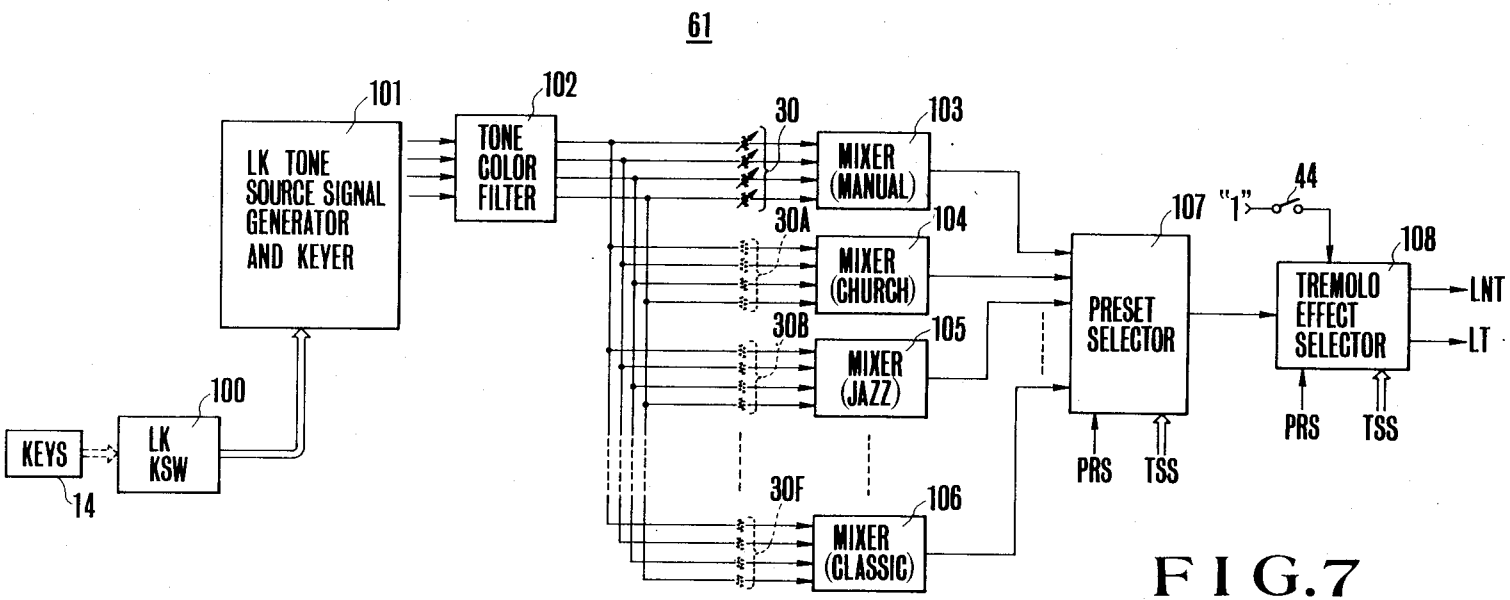
FIG. 7 is a block diagram showing the detail of a LK tone generator shown in FIG. 5.

As will be described later in detail with reference to FIG. 7, the LK tone generator 61 is constructed to generate the nontremolo musical signal LNT and the tremolo musical tone signal LT, and these signals are applied to a UL balance adjusting circuit 64 respectively through resistors 62 and 63.

The U/L balance adjusting circuit 64 supplied with musical signals from resistors 57 to 60, 62 and 63 acts to adjust the volume balance of the UK and LK musical tone signals and comprises mutually interlocked variable resistance elements **36*a* and 36*b* of the balance adjusting variable resistor 36, 6 presetting fixed resistors 36A and 36B respectively corresponding to preset musical composition fashions. The nontremolo type UK musical tone signals mixed by resistors 57 and 59 are applied to one end of the resistance elements 36*a* and the resistor 36A and to the other end thereof is applied the nontremolo type LK musical tone signal from the resistor 62. The tremolo type UK musical tone signal mixed by the resistors 58 and 60 is supplied to one end of the resistance element 36*b* and the resistor 36B, while to the other end thereof is applied the tremolo type LK musical tone signal from the resistor 63. The UK and LK musical tone signals respectively supplied to the variable resistance elements 36*a* and 36*b* are mixed together at a ratio determined by the set positions of their movable contacts and the mixed musical tone signal is derived out via the movable contacts. In the same manner, the UK and LK musical tone signals supplied to the resistors 36A and 36B are mixed together at a ratio determined by the positions of their movable contacts and then derived out therethrough. The positions of the movable contacts of the resistors 36A and 36B**, that is the ratio of admixing the musical tone signals are preset according to the musical composition fashions.

The nontremolo type mixed musical tone signal derived out from resistance element **36*a* and resistor 36A is applied to a preset selector 65, whereas the tremolo type mixed musical tone signal derived out from the variable resistance element 36*b* and the resistor 36B is applied to a preset selector 66. The selectors 65 and 66 perform similar signal selection operations according to the preset signal PRS and the musical composition fashion designation signal TSS. Thus, in the case of the preset mode wherein the preset signal PRS is "1", the musical signals from the resistors 36A and 36B are derived out, whereas, in the case of the manual mode wherein the preset signal is "0" the musical tone signals from the variable resistance elements 36*a* and 36*b* are selectively derived out. Especially, during the preset mode wherein the preset signal PRS is "1", the musical tone signal from one of the resistors 36A and 36B** corresponding to a musical composition fashion designated by the musical composition fashion designation signal TSS is selected.

Musical tone signals consisting of the nontremolo type and of the tremolo type sent from the selectors 65 and 66 are mixed together by resistors 67 and 68 and then supplied to a reverb effect imparting device 69 which imparts a residual tone or echo effect to the musical signal. The musical signal from the reverb effect imparting device 69 is applied to a preset selector 70 in parallel through the tone volume (reverb depth) adjusting variable resistor 49 mounted on the panel surface and presetting fixed resistors 49A.

The selector 70 selects a signal in accordance with the preset signal PRS and the musical composition fashion designation signal TSS in the same manner as the selector 65 described above. Thus, during the preset mode wherein the preset signal PRS is "1", the selector 70 selects the musical signal from one of the resistors 49A corresponding to the designated musical composition fashion, whereas during the manual mode in which the preset signal is "0", the selector 70 selects the musical signal from the variable resistor 49.

The tremolo type musical tone signal sent out from the preset selector 66 is applied to a tremolo effect circuit 71 where it is amplitude-modulated with a tremolo modulation low frequency signal thereby enabling the performance of a musical tone imparted with the tremolo effect. The tremolo effect circuit 71 is constructed such that the frequency of the tremolo modulation low frequency signal will be controlled by the output signal of the preset selector 72 so as to set the tremolo modulation speed. More particularly, during the preset mode wherein the preset signal PRS is "1", the selector 72, the operation thereof being controlled by the preset signal PRS and the musical composition fashion designation signal TSS, supplies a voltage corresponding to the presetting fixed resistors 42A for respective musical composition fashions to a tremolo effect circuit 77 so as to produce a constant tremolo modulation speed corresponding to that voltage. In the case of the manual mode wherein the preset signal is "0", the selector 72 supplies a control signal from the variable resistor 42 and the switch 43 mounted on the panel surface to the tremolo effect circuit 71 so as to obtain various tremolo modulation speeds corresponding to the control signal. The control modes at this time include one mode in which the switch 43 is opened to set a slow (SLOW) mode and the variable resistor 42 is set to a desired value, and the other mode in which the switch 43 is closed to set a fast mode (FAST) and the variable resistor 42 is set to a desired value.

Figure 8:
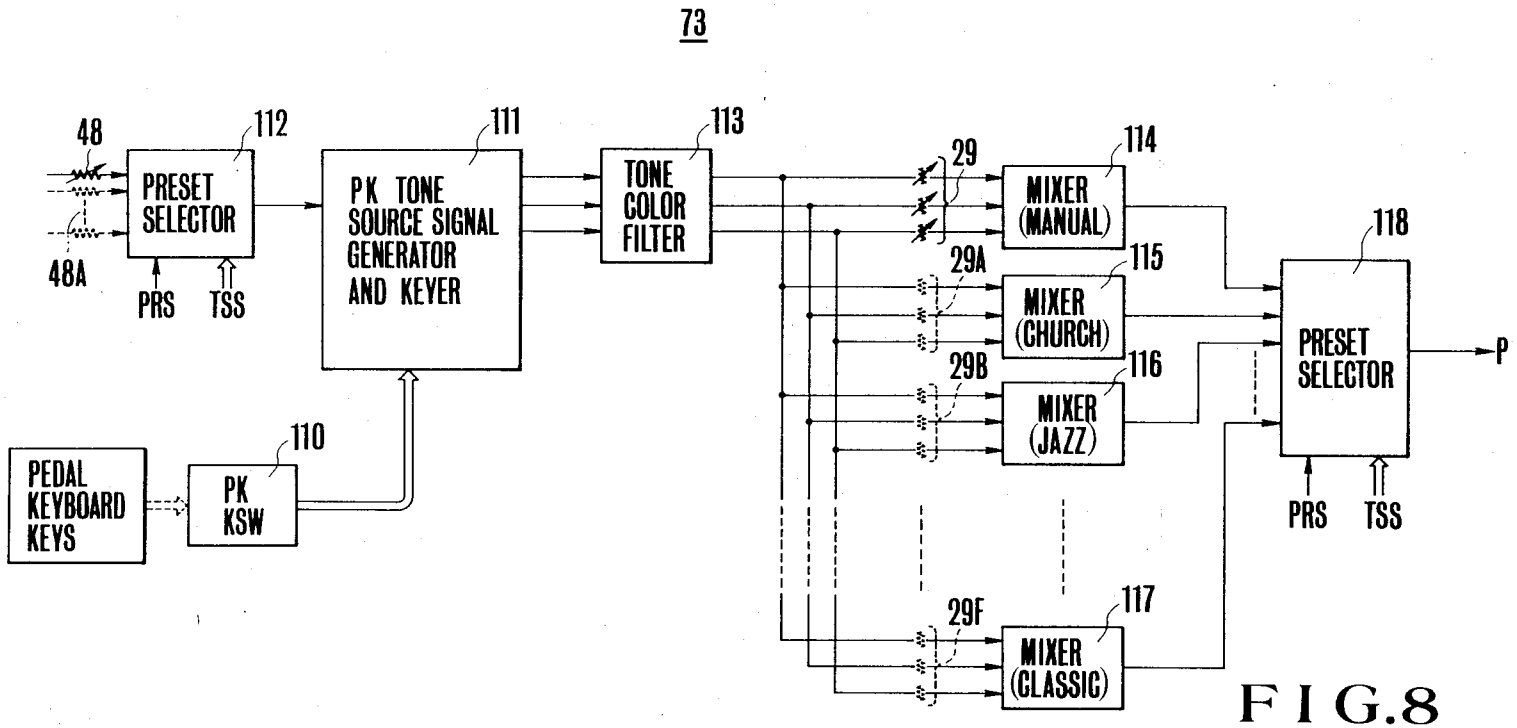
FIG. 8 is a block diagram showing the detail of a PK tone generator shown in FIG. 5.

As will be described later in detail with reference to FIG. 8, the PK tone generator 73 produces a PK musical tone signal P which is mixed with the UK and LK musical signals described above. More particularly, the nontremolo musical tone signal from the preset selector 65, and the reverb imparting musical signal from the preset selector 70, and the tremolo imparting musical signal from the tremolo effect imparting device 71, and the PK musical tone signal P from the PK tone generator 73 are mixed together respectively through resistors 74*a*, 74*b*, 74*c* and 74*d*. The mixed musical tone signal is supplied to an expression imparting device 76 actuated by an expression pedal 75 to control the tone volume according to the extent of depression of the pedal 75.

The musical tone signal produced by the expression imparting device 76 is applied to a preset selector 77 in parallel through the master volume controlling resistor 50 mounted on the panel surface and presetting fixed resistors 50A for respective musical composition fashions. In response to the preset signal PRS and the musical composition fashion designation signal TSS, the selector 77 selects the musical signal tone in the same manner as the selector 65 described above. Thus during the preset mode wherein the preset signal PRS is "1" it selects the musical tone signal from a fixed resistor corresponding to the designated musical composition fashion among the fixed resistors 50A, whereas in the case of the manual mode wherein the preset signal PRS is "0" the selector 77 selects a musical tone signal having a level set by the performer with the variable resistor 50.

The musical tone signal produced by the preset selector 77 is applied to an output amplifier 78 to be amplified. The musical tone signal thus amplified is supplied to an electro-acoustic converter 79, a loudspeaker for example, to be produced as a musical tone.

Table I below shows combinations of various elements that form musical tones shown in FIG. 8 corresponding to respective musical composition fashion switches 22 to 27 which are provided according to this invention. In Table I, numerals "0" through "3" represent relative amounts of respective tones to be mixed mutually or amounts of operation of the tone volumes, each of which sets the mixing amounts of the tones to be mixed. For example, the numeral "3" means that the mixing amount of the tone is the maximum, whereas the numeral "0" means that the tone is not mixed with the other tones.

TABLE 1

| Selection switch | musical composition fashion | PK | | | IK | | | | UK | |
|---|---|---|---|---|---|---|---|---|---|---|
| | | bass 16′ | bass 8′ | bass guitar | flute 8′ | flute 4′ | diapason 8′ | horn 8′ | attack 4′ | flute 16′ |
| 22 | church fashion | 3 | 1 | 0 | 2 | 3 | 3 | 1 | 0 | 2 |
| 23 | jazz fashion | 0 | 1 | 2 | 2 | 2 | 0 | 0 | 2 | 3 |
| 24 | pops fashion | 1 | 2 | 1 | 3 | 1 | 2 | 0 | 0 | 0 |
| 25 | mood music fashion | 1 | 2 | 0 | 2 | 1 | 0 | 0 | 0 | 0 |
| 26 | children's song fashion | 0 | 3 | 0 | 1 | 0 | 0 | 2 | 0 | 0 |
| 27 | classic fashion | 1 2 | 0 | 3 | 3 | 0 | 0 | 0 | 3 | |

| Selection switch | musical composition fashion | UK | | | | | | | | | | | |
|---|---|---|---|---|---|---|---|---|---|---|---|---|---|
| | | flute 8′ | flute 4′ | flute 2⅔′ | flute 2 | trom-bone 16′ | trumpet 8′ | piano | pops 8′ | strings 8′ | vibrato depth | vibrato speed | vibrato delay |
| 22 | church fashion | 2 | 3 | 2 | 0 | 1 | 2 | 0 | 3 | 2 | 0 | 0 | 0 |
| 23 | jazz fashion | 3 | 1 | 0 | 0 | 0 | 0 | 0 | 0 | 0 | 0 | 0 | 0 |
| 24 | pops fashion | 0 | 0 | 0 | 0 | 0 | 0 | 3 | 0 | 0 | 0 | 0 | 0 |
| 25 | mood music fashion | 0 | 0 | 0 | 0 | 0 | 0 | 0 | 3 | 0 | 3 | 1 | 1 |
| 26 | children's song fashion | 2 | 0 | 0 | 0 | 0 | 0 | 0 | 0 | 2 | 1 | 1 | 0 |
| 27 | classic fashion | 2 | 3 | 2 | 0 | 0 | 0 | 0 | 0 | 0 | 3 | 1 | 0 |

| musical composition | U/L | Tremolo | | | master |
|---|---|---|---|---|---|
| | | slow/ | UK | UK | |

TABLE 1-continued

| Selection switch | fashion | balance | speed | fast | LK | orchestra | flute | UK sustain | PK sustain | revert | volume |
|---|---|---|---|---|---|---|---|---|---|---|---|
| 22 | church fashion | U SIDE | 1 | slow | ON | ON | ON | 2 | 2 | 3 | 2 |
| 23 | jazz fashion | U SIDE | 2 | fast | ON | OFF | ON | 0 | 2 | 3 | 2 |
| 24 | pops fashion | U SIDE | 2 | fast | ON | OFF | ON | 0 | 2 | 3 | 2 |
| 25 | mood music fashion | U SIDE | 1 | slow | ON | OFF | OFF | 0 | 2 | 3 | 1 |
| 26 | children's song fashion | U SIDE | 1 | slow | ON | ON | OFF | 0 | 2 | 1 | 2 |
| 27 | classic fashion | U SIDE | 2 | fast | ON | OFF | ON | 2 | 2 | 3 | 2 |

The detail of the UK tone generator 56 will now be described with reference to FIG. 6 which comprises a key switch circuit (KSW) 80 corresponding to UK 15 described above and applies to a tone source signal generator and keyer 81 a key state signal representing a depressed key of the upper keyboard. The tone source signal generator and keyer 81 comprises a tone source unit which generates a tone source signal having a frequency corresponding to all keys of the upper keyboard UK, and a switching unit which derives out a tone source signal from the tone source unit according to the key state signal from the key switch circuit 80, and has a construction disclosed in Japanese Preliminary Publication of Pat. No. Sho 54-61,916 published on May 18, 1979 corresponding to U.S. Pat. No. 4,191,082 dated Mar. 4, 1980, and Preliminary Publication of Utility Model Nos. Sho 54-69,819 and 54-69,820 both dated May 18, 1979. The tone source unit is also provided with a vibrato effect circuit that subjects the tone source signal to a frequency modulation with the vibrato modulation low frequency signal.

A preset selector 82 is provided for supplying to the tone source signal generator and keyer 81 a control signal that designates the sustain time SUS of the envelope, a control signal that designates the vibrato depth PEP, a control signal that designates the vibrato speed VSP, and a control signal that designates the vibrato delay VDEL, and to the input of the preset selector 82 are applied voltage signals from the variable resistors 33, 34, 35 and 47 mounted on the panel surface, and the voltage signals from the presetting fixed resistors 33A, 34A, 35A and 47A. Each of the fixed resistors 33A, 34A, 35A and 47A comprises a set of 6 resistors for above described 6 preset musical composition fashions. The signal selection operation of the preset selector 82 is controlled by the preset signal PRS and the musical composition fashion designation signal TSS.

Assuming now a preset mode in which the preset signal PRS is "1", the selector 82 selects the voltage signal of one resistor corresponding to the musical composition fashion designated by the musical composition fashion designation signal TSS among fixed resistors 33A, 34A 35A and 47A. As a consequence, in this case, the vibrato depth VDEP, the vibrato speed VSP, the vibrato delay time VDEL, and the sustain time SUS are respectively determined by the preset voltages from fixed resistors 33A, 31A, 36A and 47A. On the other hand, during the manual mode wherein the preset signal PRS is "0" the above described control caused by the musical composition fashion designation signal TSS becomes impossible and instead the selector 82 selects the voltage signals from the variable resistors 33, 34, 35 and 47. For this reason, the vibrato depth VDEP, the vibrato speed VSP, the vibrato delay time VDEL and the sustain time SUS are determined respectively by variable resistors 33, 34, 35 and 47.

The output signal of the tone source signal generator and keyer 81 is applied to a flute tone color filter circuit 83 to form respective tone colors by filters corresponding to tone colors At4', FL16', FL8', FL4', FL2⅔' and FL2'. The musical tone signals from the filter circuit 83 are applied to a mixer 84 via tone volume adjusting variable resistor 31 to be mixed with each other. For this reason, the mixer 84 produces a musical tone signal corresponding to the setting of the tone volume adjusting variable resistor 31. The musical tone signals produced by the filter circuit 83 are also applied to mixer circuits 85, 86, . . . 87 via corresponding 6 sets of fixed resistors 31A, 31B . . . 31F for respective musical composition fashions. The values of respective sets of the fixed resistors 31A, 31B . . . 31F are set to emphasize respective ones of the church fashion, the jass fashion . . . classic fashion. Thus, the mixer circuits 85, 86 . . . 87 produce musical tones respectively emphasized with the church fashion, jazz fashion . . . classic fashion.

The musical tone signals respectively produced by mixer circuits 84, 85, 86 . . . 87 are applied to a preset selector 88 which in response to the preset signal PRS and the musical composition fashion designation signal selects the musical tone signal. Thus, during the preset mode wherein the preset signal is "1", the selector 88 selects a signal corresponding to a musical composition fashion designated by the musical composition fashion designation signal TSS whereas during the manual mode wherein the preset signal PRS "0" selects the musical tone signal from the mixer circuit 84. The musical tone signal thus selected is supplied to a tremolo effect selector 89.

This circuit is provided for the purpose of imparting (tremolo) or not imparting (nontremolo) a tremolo effect and operates in response to the preset signal PRS, the musical composition fashion designation signal TSS, and a state signal from the flute UK tone designation switch 46 regarding the tremolo. More particularly, during the preset mode, since either one of the bits of the musical composition fashion designation signal TSS is "1", non imparting of the tremolo effect is selected so that the switching circuit 89 would produce a flute nontremolo musical tone signal. During the manual mode wherein the preset signal PRS is "0", the control by the musical composition fashion designation signal TSS becomes impossible, but instead the control by the designation switch 46 becomes effective. In this case, if the designation switch 46 is open and its state signal is "0", a flute nontremolo musical tone signal UFNT would be sent out, whereas when the designation switch 46 is closed and its state signal is "1" a flute tremolo musical tone signal UFT would be sent out.

The output signal from the tone source signal generator and keyer 81 is also supplied to an orchestra tone color filter circuit 90 for discrete feed rates to form respective tone colors by filters corresponding to respective tone colors of TB16', TP8', piano, CL8' and ST8'. The musical tone signals from the filter circuit 90 are applied to a mixer 91 through tone volume adjusting variable resistors 32 provided for respective tone colors TB16', TP8', piano, CL8' and ST8' to be mixed together. Accordingly, the mixer 91 produces a musical tone signal corresponding to the settings of the volume adjusting variable resistors 32. The musical tone signal produced by the filter 90 is also supplied to mixers 92, 93 . . . 94 respectively through corresponding six sets of fixed resistors 32A, 32B . . . 32F for different musical composition fashions and mixed together.

The resistance values of the sets of the fixed resistors 32A, 32B . . . 34F are set to emphasize the tone colors of the church fashion, jazz fashion . . . classic fashion so that the mixers 92, 93 . . . 94 respectively send out the tone colors of church fashion, jazz fashion . . . classic fashion.

The musical tone signals respectively produced by mixers 91, 92, 93 . . . 94 are applied to preset selector 95 which selects signals in the same manner as the preset selector 88 described above. During the preset mode in which the preset signal is "1", a signal corresponding to a musical composition fashion designated by the music composition fashion designation signal TSS among the musical tone signals from the mixers 92, 93 . . . 94, whereas during the manual mode wherein the preset signal PRS is "0", the selector 95 selects the musical tone signal from the mixer 91. The musical tone signal thus selected is applied to a tremolo effect selector 96.

The tremolo effect selector 96 has a similar construction and operates in the same manner as the tremolo effect selector 89 described above. More particularly, during the preset mode wherein the preset signal is "1", the nonimparting of the tremolo effect is selected when either one of the bits of the musical fashion designation signal becomes "1", while the selector 96 produces an orchestra nontremolo musical tone signal UONT. During the manual mode (PRS="0") an orchestra nontremolo musical tone signal UONT is produced when the orchestra UK tone designation switch concerning the tremolo is OFF whereas when the switch 45 is ON, an orchestra tremolo musical tone signal UOT would be produced.

The detail of the LK tone generator 61 will now be described with reference to FIG. 7. A key switch circuit 100 corresponding to the aforementioned LK 14 is provided to supply a key state signal indicative of a depressed key of the lower keyboard LK to a tone source signal generator and keyer 101 which comprises a tone source unit generating a tone source signal of a frequency corresponding to all keys of the lower keyboard LK and a switching unit for deriving out the tone source signal generated by the tone source unit according to a key state signal from the key switch circuit 100. This construction is similar to that disclosed in Japanese Preliminary Publication of Pat. No. Sho 54-61,916 described above.

The output signal of a tone source signal generator and keyer 101 is supplied to a tone color filter circuit 102 to form tone colors so that they become those of flute 8', flute 4, diapason and horn 8' respectively. The musical tone signal from the filter circuit 102 applied to a mixer 103 through tone volume adjusting variable resistors 30 provided for respective tone colors to be mixed together. Consequently, the mixer 103 sends out a musical tone signal corresponding to the setting of the tone adjusting variable resistor 30, while the musical signal from the filter 102 is supplied to mixers 104, 105 . . . 106 respectively through 6 sets of fixed resistors 30A, 30B . . . 30F for different musical composition fashions to be mixed together. The values of each set of these fixed resistors are set to respectively emphasize the church fashion, jazz fashion . . . classic fashion, whereby mixers 104, 105 . . . 106 send out respectively musical tone emphasized tone colors of church fashion, jazz fashion . . . classic fashion, and these musical tone signals are applied to a preset selector 107 which selects signals in the same manner as the preset selector 88 (FIG. 3) described above. In the case of the preset mode wherein the preset signal PRS is "1", the selector 107 selects a signal corresponding to a musical composition fashion designated by the musical composition fashion designation signal whereas in the case of the manual mode wherein the preset signal is "0", selects the musical tone signal from the mixer 103. The musical tone signal thus selected is supplied to a tremolo effect selector 108.

Figure 6:
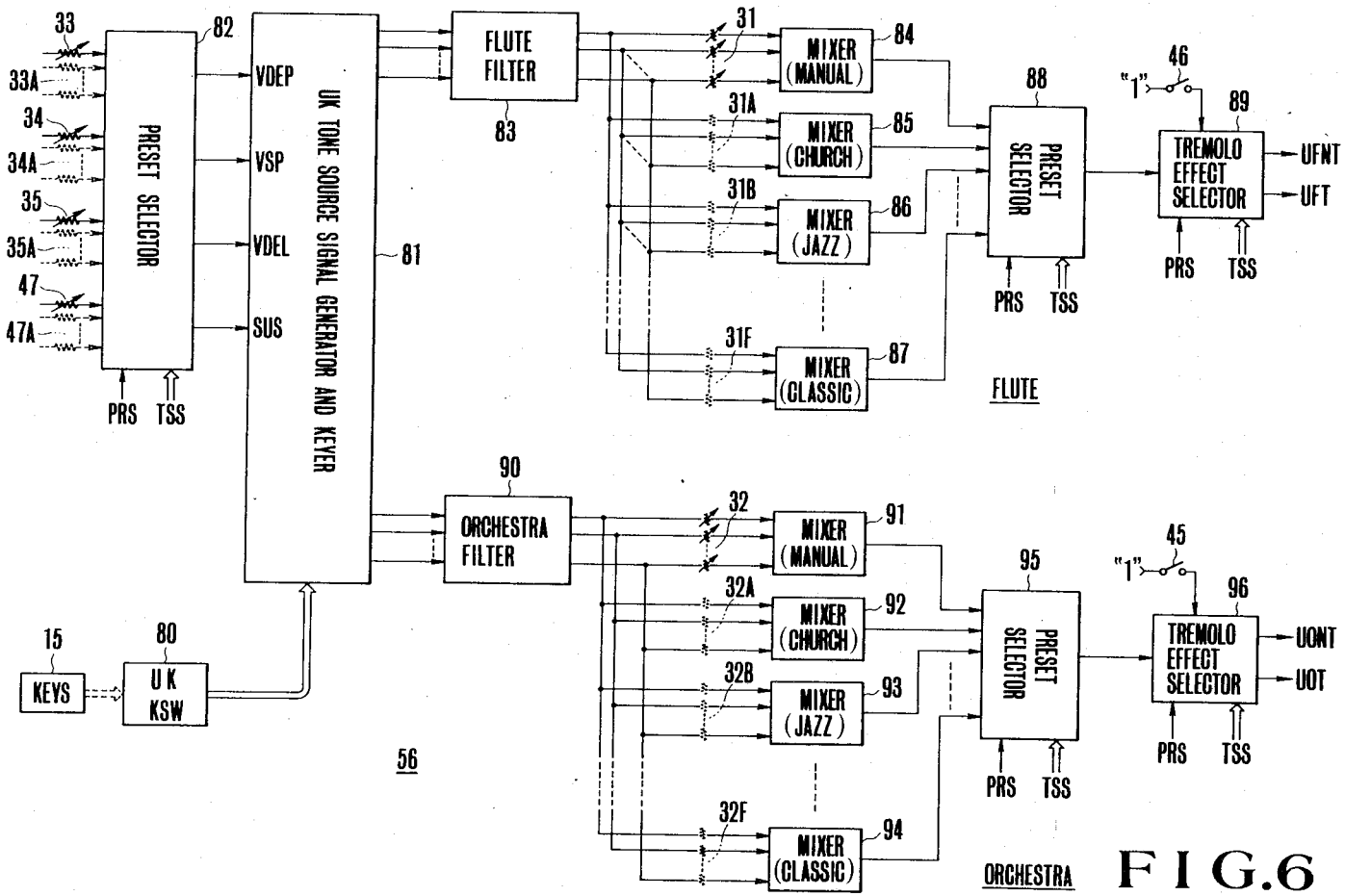
FIG. 6 is a block diagram showing the detail of a UK tone generator shown in FIG. 5.

The tremolo effect selector 108 operates in the same manner as the tremolo effect selector 69 (FIG. 6). Thus, during the preset mode wherein the preset signal PRS is "1", when either one of the bits of the musical composition fashion designation signal TSS becomes "1" the tremolo effect selector 108 selects nonimpartion of the tremolo effect to send out nontremolo musical tone signal LNT during the manual mode wherein the preset signal PRS is "0" the tremolo effect selector 108 produces the nontremolo signal LNT when the LK tone designation switch 44 regarding the tremolo is OFF, whereas when the switch 44 is ON produces a tremolo musical tone signal LT.

The detail of the PK tone generation circuit 73 will now be described with reference to FIG. 8. A key switch circuit 110 concerning the pedal keyboard PK (not shown) is provided for supplying a key state signal indicative of the depressed key of the pedal keyboard PK to a tone source signal generator and keyer 111 which comprises a tone source unit for generating a tone source signal having a frequency corresponding to all keyboard keys of the pedal keyboard PK and a switching unit which derives out the tone source signal generated by the tone source unit according to a key state signal produced by the key switch unit. This construction is similar to that disclosed in Japanese Preliminary Publication of Pat. No. Sho 54-61,916. The length of the sustain time SUS of the envelope resulting from the operation of the switching unit is controlled by the output signal from the preset selector 112 which, during preset mode, selects a votage signal from a resistor corresponding to a musical composition fashion designated by the musical composition fashion designation signal TSS among presetting fixed resistors 48A, whereas during the manual mode selects a voltage signal from the variable resistor mounted on the panel surface. For this reason, the sustain time SUS is set according to the voltage from the fixed resistors 48A during the preset time whereas during the manual mode the sustain time is set according to the voltage from the variable resistor 48.

The musical tone signal generated by the tone source signal generator and keyer 111 is applied to a tone color filter circuit 113 to form tone colors of a bass 16', a bass 8' and a bass guitar. The musical tone signals generated by the filter circuit 113 are supplied to a mixer 114 via tone volume adjusting variable registers 29 provided for respective tone colors to be mixed together. As a consequence, the mixer 114 sends out a musical tone signal having colors determined by the settings of the tone volume adjusting variable resistors 29. The musical tone signal generated by the filter circuit 113 is applied to mixers 115, 116 . . . 117 respectively through corresponding 6 fixed resistors 29A, 29B . . . 29F for different musical composition fashions to be mixed together. The values of respective sets of fixed resistors 29A, 29B . . . 29F are determined to emphasize the musical composition fashions of the church fashion, the jazz fashion . . . classic fashion respectively. As a consequence, mixers 115, 116 . . . 117 produce musical tone signals of the church fashion, the jazz fashion . . . classic fashion, the tone colors thereof have been emphasized.

The musical tone signals sent out from the mixers 114, 115, 116 . . . 117 are supplied to a preset selector 118 which selects the signals in the same manner as the preset selector 88 (FIG. 6) described above. During the preset mode wherein the preset signal PRS is "1", the preset selector 118 selects a signal corresponding to a musical composition fashion designated by the musical composition fashion designation signal TSS among signals produced by the mixers 115, 116, . . . 117, whereas during the manual mode, selects the musical signal from the mixer 114 thereby sending out a PK musical tone signal consisting of the selected signal.

In the foregoing embodiment, the value of the presetting fixed resistor shown by dotted lines in FIGS. 5 through 8 is determined during the manufacturing step thereof. This resistor may be a permanently fixed resistor, but a semifixed resistor is preferred from the standpoint of adjustment at the manufacturing step. The switching between the preset mode and the manual mode may be automatically interlocked with the opening and closing operations of the blind unit.

As above described, the electronic musical instrument embodying the invention permits two modes of performances, i.e., the preset mode and the manual mode. Especially in the preset mode, it is possible to extremely readily select a desired musical composition fashion by selecting any one of a plurality of the musical composition fashion selection switches. More particularly, in the case of the preset mode the operation of the operating members in the blind unit is made invalid so that the control of the musical tone is performed automatically according to the control information which has been preset into a plurality of preset units shown by broken lines and moreover, since it is possible to preset a tone color corresponding to a desired musical composition fashion by the manipulation of the musical composition fashion selection switch, the manipulation on the panel surface can be simplified greatly, which is especially beneficial to relatively unskilled performers. Furthermore, during the manual mode, instead of invalidating the preset control information, it becomes possible to utilize the control information caused by the manipulation of respective control members in the blind unit which is benefical for skilled performers because they can enjoy performances by adding various variations.

Figure 5:
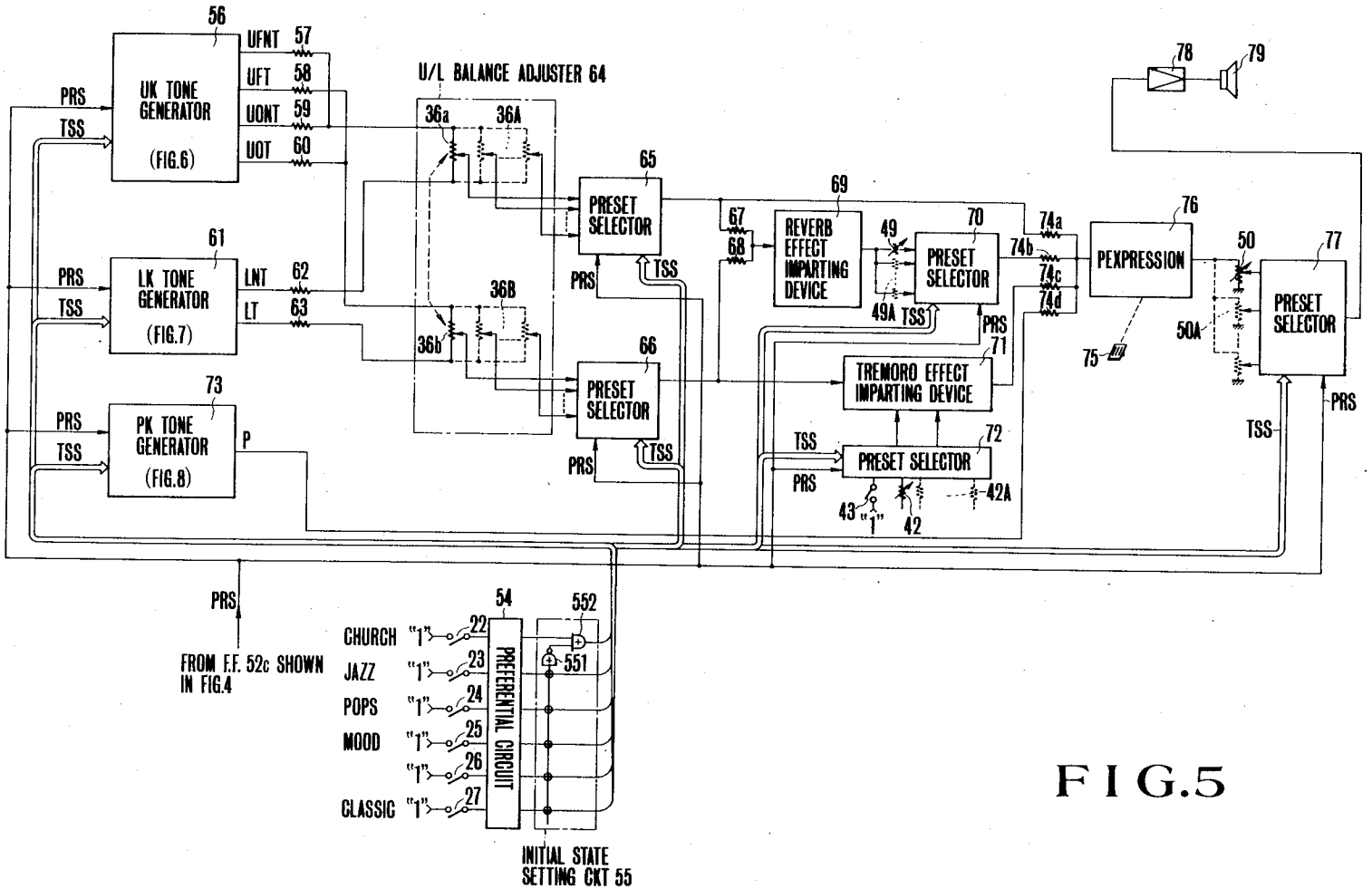
FIG. 5 is a block diagram showing the construction of a musical tone forming and controlling unit of the electronic musical instrument shown in FIG. 1.
Figure 9:
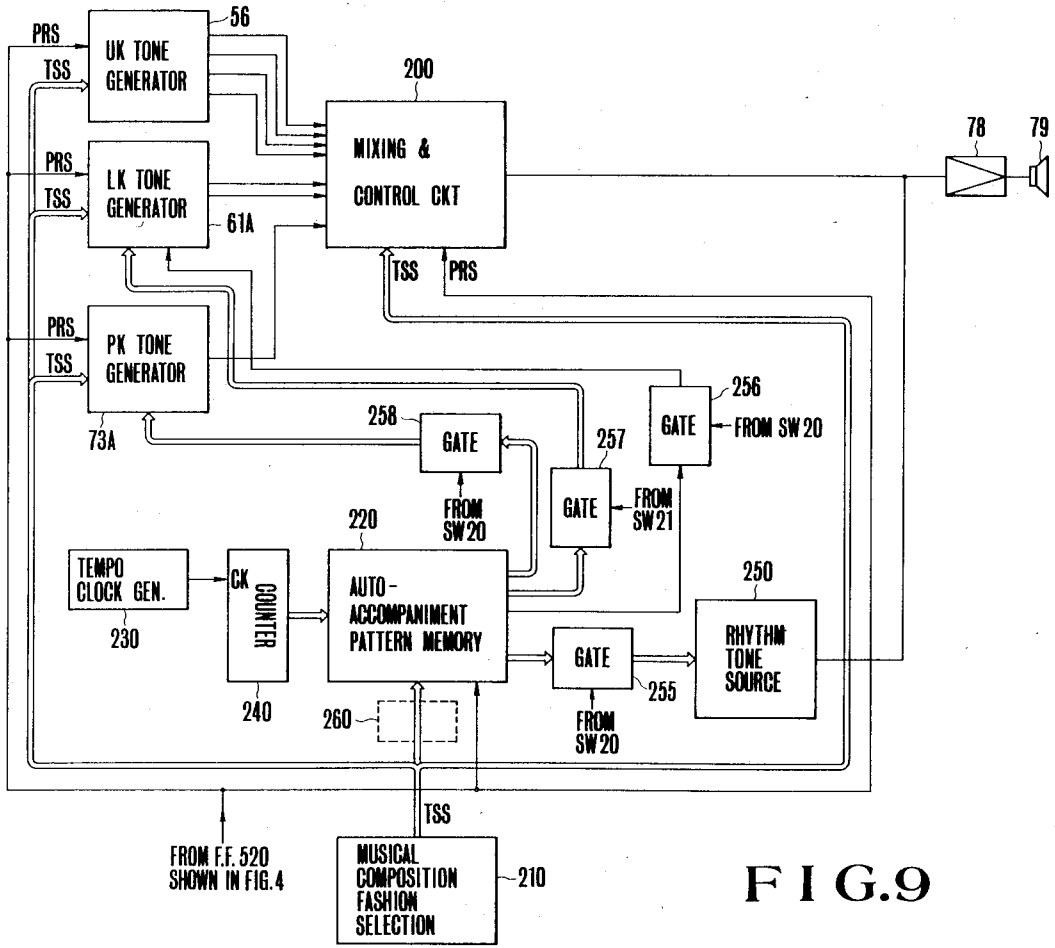
FIG. 9 is a block diagram showing a modified circuit construction of the electronic musical instrument according to this invention.

FIG. 9 illustrates a modified electronic musical instrument of this invention which is constructed to select the rhythm pattern by the output of the musical composition fashion selection switch and the circuit elements corresponding to those shown in FIG. 5 are designated by the same reference characters. The outputs produced by the UK tone generator 56, the LK tone generator 61A and the PK tone generator 73A are sent to a combined mixing and the effect control circuit 200 having the same construction as those of the elements arranged between the signal generator 56, 61A and 73 and the amplifier 78, and which operates in the same manner. A musical composition fashion selection device 210 is constituted by the musical composition fashion selection switches 22 through 27, the preferential circuit 54 and the initial state setting circuit 55 shown in FIG. 5 so that it operates in the same manner.

Figure 10:
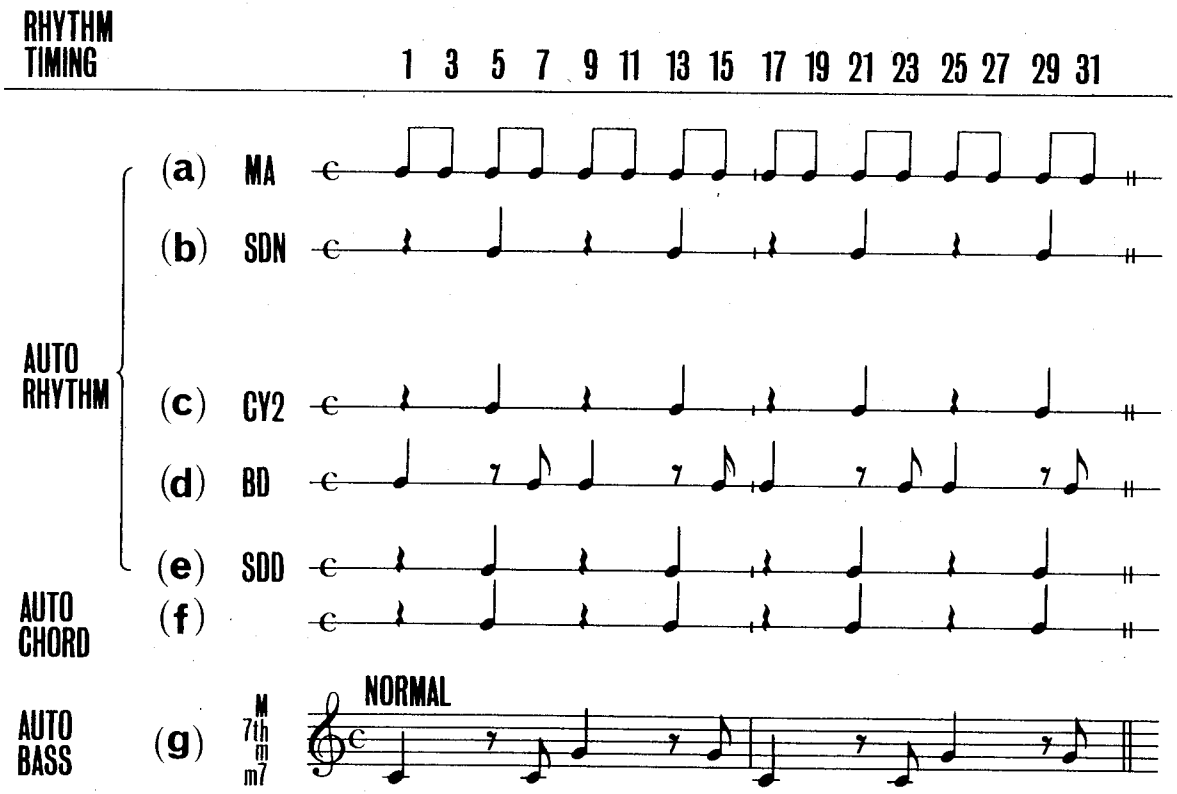
FIG. 10 is a score useful to explain the operation of the modified embodiment shown in FIG. 9.

The modified embodiment shown in FIG. 9 differs from the embodiment shown in FIG. 5 in that it comprises a auto-accompaniment (auto-rhythm, auto-bass/-chord, or auto-arpeggio) pattern memory device 220 which is used to memorize the automatic accompaniment and is ordinary constituted by a ROM. Upon reception of the musical composition fashion designation signal TSS from the musical composition fashion selection device 210 a pattern commensurate with the designated musical composition fashion would be selected among the patterns stored in the memory device 220, and selected patterns are sequentially sent out according to the output of the counter 240. A tempo clock generator 230 is provided to apply a tempo clock pulse to a terminal CK of a counter 240 which sends its count value to the memory device 220 to act as an address selection signal. One of the outputs of the memory device 220 is sent to a rhythm tone source 250 via a gate circuit 255 enabled or disabled by the auto-bass/chord switch 20 shown in FIG. 1. In this modification, the rhythm tone source includes five different tone sources of a maracus (MA) a brush (CSDN), a high hat cymbal (CCY2) a bass drum (BD) and a snare drum (SDD). Consequently, the signal sent via the gate circuit 255 is applied to the rhythm tone source 250 via different channels. The output of the rhythm tone source 250 supplies tones (a) to (e) shown in FIG. 10, for example to the amplifier 78.

One of the outputs of the memory device 220 is sent through a channel to the LK tone generator 61A via gate circuit 256 controlled by the output of the auto-bass/chord switch 20 described above. The auto-chord performance is performed by the LK tone generator 61A and the circuit construction operated by the memory output at this time is disclosed in Hirose U.S. Pat. No. 4,065,993 dated Jan. 3, 1978.

Another one of the outputs of the memory device 220 is sent to the LK tone generator through a gate circuit 257 controlled by the output of auto-arpeggio switch 21 by using a plurality of channels. This output is produced by the arpeggio generator 61A disclosed in Ishii U.S. Pat. No. 4,182,212 dated Jan. 8, 1980. The remaining one of the outputs of the memory device 220 is sent to the PK tone generator 73A via a gate circuit 258 controlled by the output of the auto-bass/chord switch 20 through a plurality of channels. The circuit elements of the PK tone generator 73A which are operated by the output of the memory device is disclosed in above described U.S. Pat. No. 4,065,993.

With this construction, upon closure of either one of the switches 22 to 27 of the musical composition fashion selector 210, a musical composition fashion designation signal TSS corresponding to the closed switch is applied to the pattern memory device 220, respective generators 50, 61A and 73 and the combined mixing and effect controlling circuit 200. The operation of the generators 56, 61A and 73A and the circuit 200 when they receive the musical composition designation signal TSS are identical to those of the previous embodiment. Upon receival of the musical composition fashion signal TSS, the combined auto-accompaniment pattern memory device 220 selects a pattern commensurate with the musical composition fashion of the signal for sequentially reading out the pattern in accordance with the output of the counter 240.

When switches 20 and 21 are both open, the output of the memory device 220 would not be sent to succeeding stages when any one of the switches of the muical composition selection device is closed with the result that the auto-accompaniment would not be performed. Thus, it is only necessary to preset various parameters that comprise the musical tone to be suitable for the musical composition fashion in the same manner as the previous embodiment.

Where any one of the switches of the musical composition fashion selection device is selected and when the auto-bass/chord switch 20 is closed, the output of the memory device 220 is sent to the rhythm tone source 250, and the LK and PK tone generators 61A and 73A thus forming a LK tone (chord) in synchronism with the timing of the rhythm pattern output. Where the auto-arpeggio switch 21 is closed, LK depressed key tones constituting an arpeggio are sequentially formed by the output of the memory device 220. The output of the memory device 220 at this time shows a tone producing timing information and the fact that a tone of which order of the depressed key tones.

Although in FIG. 9 supply of the output of the memory device to succeeding stages is controlled by gate circuits 256 through 257, it is possible to provide a gate circuit 260 that controls the supply of the signal TSS to the memory device and to control this gate circuit by the outputs of auto-bass/chord switch 20 and the auto-arpeggio switch 21.

What is claimed is:

1. A musical instrument system comprising:

a plurality of keyboards each having a plurality of keys for designating musical tones;

a corresponding plurality of tone generator means each coupled to an associated one of said keyboards for generating a first set of tone signals to be reproduced with a tremolo effect and a second set of tone signals to be reproduced with a nontremolo effect;

balance adjusting means coupled to said tone generators for providing a first plurality of balance adjusting ratio paths between the tremolo effect tone signals from said plurality of tone generating means and a second plurality of balance adjusting ratio paths between non-tremolo effect tone signals from said plurality of tone generating means, each of said first and second plurality of paths having one manually adjustable path and remaining preset paths;

first selector means coupled to said balance adjusting means for selecting tremolo effect tone signals from one of said paths and non-tremolo effect tone signals from one of said paths;

reverberation effect imparting means coupled to said first selector means for adding a reverberation effect to the signals output from said first selector means;

means coupled to said reverberation effect imparting means for providing a plurality of reverberation depth circuit paths for the signals output from said reverberation effect imparting means, one of said plurality of reverberation depth circuit paths being manually adjustable and the remaining such paths being preset;

second selector means coupled to said plurality of reverberation depth circuit paths for selecting reverberation signals from one of said reverberation depth circuit paths;

means coupled to said first selector means for imparting a tremolo effect to said tremolo effect tone signals;

third selector means coupled to said tremolo effect imparting means for specifying one of a plurality of tremolo effects to be imparted to said tremolo effect tone signals, one of said tremolo effects being manually adjustable and the remaining tremolo effects being preset;

expression means coupled to said first selector means, said second selector means and said tremolo effect imparting means for combining the non-tremolo effect tone signals, the reverberation effect tone signals and the tremolo effect tone signals into composite tone signals;

means coupled to said expression means for providing a plurality of maximum volume control paths for said composite tone signals, one of said paths being manually adjustable and the remaining paths being preset;

fourth selector means coupled to said maximum volume control path means for selecting one of said plurality of maximum volume control paths;

amplifier means coupled to the output of said fourth selector means for amplifying the composite signals supplied thereto via said one of said plurality of maximum volume control paths; and control means coupled to said first, second, third and fourth selector means for controlling the associated selecting function, said control means including first manually actuatable means for specifying one of the plurality of preset parameters in said selector means, and two state control signal generating means for generating a signal specifying alternative operation of said selector means in the preset parameter mode or the manual parameter mode.

2. The invention of claim 1 wherein one of said plurality of tone signal generating means includes flute tone generating means for generating flute tone signals to be reproduced with a tremolo effect and flute tone signals to be generated with a non-tremolo effect, and orchestra tone generating means for generating orchestra tone signals to be reproduced with a tremolo effect and orchestra tone signals to be reproduced with a non-tremolo effect; and wherein said flute and orchestra tremolo effect tone signals are coupled in parallel to said balance adjusting means, and said flute and orchestra non-tremolo effect tone signals are coupled in parallel to said balance adjusting means.

3. The invention of claim 1 wherein said first plurality of balance adjusting ratio paths is provided by a first set of parallel coupled variable resistance devices, one of said devices being manually adjustable and the remaining ones of said devices being preset, one terminal of said first set being coupled to the tremolo effect tone signals from one of said tone generating means and the other terminal of said first set being coupled to the tremolo effect tone signals from another one of said tone generating means;

and wherein said second plurality of balance adjusting ratio paths is provided by a second set of parallel coupled variable resistance devices, one of said devices being manually adjustable and the remaining ones of said devices being preset, one terminal of said second set being coupled to the non-tremolo effect tone signals from one of said tone generating means and the other terminal of said set being coupled to the non-tremolo effect tone signals from another one of said tone generating means.

4. The invention of claim 1 further including an additional tone generating means coupled to one of said keyboards for generating an additional set of tone signals, said additional tone generating means having an output coupled to said expression means.

5. The invention of claim 1 wherein said first selector means includes a first selector section having an input coupled to said first plurality of balance adjusting ratio paths, and a second selector section having an input coupled to said second plurality of balance adjusting ratio paths, the first selector section having an output coupled to said reverberation effect imparting means and said tremolo effect imparting means, the second selector section having an output coupled to said expression means and said reverberation effect imparting means.

6. A tone signal generating system for a keyboard musical instrument having a plurality of keys each representative of a different musical tone in a scale, said tone signal generating system comprising:

tone source signal generating means for generating a plurality of fundamental tone signals in response to the actuation to a given key on the instrument keyboard;

first tone color filter means coupled to said tone source signal generating means for modifying said plurality of fundamental tone signals to provide a corresponding plurality of tone color signals;

a first plurality of mixer means coupled to the output of said tone color filter means for mixing said plurality of tone color signals, each of said mixer means having a set of variable resistance devices for receiving a different one of said tone color signals and providing selective attenuation for said plurality of tone color signals, one of said sets of variable resistance devices being manually adjustable and the remaining sets of said variable resistance devices being preset;

first selector means coupled to the outputs of said plurality of mixer means for selecting the mixed tone color signals output from one of said plurality of mixer means in accordance with first and second control signals supplied thereto; and control signal generating means coupled to said first selector means for providing said first and second control signals thereto, said control signal generating means including first manually actuatable means for specifying one of said plurality of mixer means having said preset variable resistance devices to be selected, and two state mode control means for generating a signal specifying alternate operation of said selector means in a preset variable resistance device mode or a manually adjustable variable resistance device mode.

7. The invention of claim 6 wherein said tone source signal generating means includes a tone sustain circuit; wherein said tone signal generating system further includes a sustain selector coupled to said tone source signal generating means, said sustain selector having a plurality of variable resistance devices for specifying the amount of sustain, one of said variable resistance devices being manually adjustable, and the remaining ones of said variable resistance devices being preset; and wherein said control signal generating means is additionally coupled to said sustain selector.

8. The invention of claim 6 wherein said tone signal generating system includes a first tremolo effect selector means coupled to the output of said first selector means for specifying whether the mixed tone color signals output therefrom are tremolo or non-tremolo effect signals; and wherein said control signal generating means is additionally coupled to said tremolo effect selector.

9. The invention of claim 8 wherein said tone signal generating system further includes a second tremolo effect selector means coupled to the output of said second selector means for specifying whether the mixed orchestra tone color signals output therefrom are tremolo or non-tremolo effect signals; and wherein said control signal generating means is additionally coupled to said tremolo effect selector.

10. The invention of claim 6 wherein said tone source signal generating means includes means for imparting a vibrato effect to said fundamental tone signals; wherein said tone signal generating system further includes vibrato selector means coupled to said tone source signal generating means for specifying said vibrato effect, said vibrato selector means including a plurality of variable resistance devices, one of said variable resistance devices being manually adjustable, the remaining ones of said variable resistance devices being preset; and wherein said control signal generating means is additionally coupled to said vibrato selector means.

11. The invention of claim 6 wherein said first tone color filter is a flute filter; and wherein said tone signal generating system further includes:

second tone color filter means coupled to said tone source signal generator means for modifying a plurality of fundamental tone signals to provide a corresponding plurality of orchestra tone color signals;

a second plurality of mixer means coupled to the output of said second tone color filter means for mixing said plurality of orchestra tone color signals, each of said second plurality of mixer means having a set of variable resistance devices for receiving a different one of said orchestra tone color signals and providing selective attenuation for said plurality of orchestra tone color signals, one of said sets of variable resistance devices being manually adjustable, and the remaining sets of said variable resistance devices being preset;

second selector means coupled to the outputs of said second plurality of mixer means for selecting the mixed orchestra tone color signals output from one of said plurality of second mixer means in accordance with first and second control signals supplied thereto;

and wherein said control signal generator means is additionally coupled to said second selector means.

12. An electronic musical instrument comprising:

at least one keyboard section having a plurality of keys corresponding to different tones of a musical scale;

tone forming means coupled to said at least one keyboard section for forming a tone having a pitch corresponding to a depressed key of said at least one keyboard section; and control means for controlling a manner of tone production of said tone in accordance with a set of tone production parameters;

said control means comprising:

manual parameter setting means for setting manually a set of manual tone production parameters which are individually variable;

specifying means for specifying a particular one of a plurality of sets of preset tone production parameters which are preset in advance; and adopting means including a single two state switch means coupled to said manual parameter setting means and said specifying means for alternately adopting said manual tone production parameters and said specified preset tone production parameters as said tone production parameters in mutually exclusive manner according to the state of said switch means.

13. The invention of claim 12 wherein said at least one keyboard section includes an upper keyboard, a lower keyboard and a pedal keyboard.

14. The invention of claim 12 wherein said manual parameter setting means includes a plurality of manually operable members for setting individually said manual tone production parameters, and a normally closed blind unit containing said manually operable members.

15. The invention of claim 12 wherein said control means further comprises a device for performing an auto-accompaniment suitable for being combined with said tone production parameters.

16. The invention of claim 15 wherein said auto-accompaniment is selected from an auto-rhythm, and auto-base/chord and an auto-arpeggio.

17. An electronic musical instrument comprising:

keyboard sections having a melody keyboard section for a melody performance and an accompaniment keyboard section for an accompaniment performance, each of said melody keyboard section and said accompaniment keyboard section having a plurality of keys designating different pitches respectively;

melody tone forming means connected to said melody keyboard section for forming a melody tone having a pitch designated by a key depression in the said melody keyboard section;

accompaniment tone forming means connected to said accompaniment keyboard section for forming an accompaniment tone having a pitch designated by a key depression in said accompaniment keyboard section;

switch means mounted on a control panel for manually selecting one of a plurality of classification types;

a melody preset device for permanently presetting a plurality of melody parameters each of which determines tone color of said melody tone and corresponds to one of said classification types; and an accompaniment preset device for permanently presetting a plurality of accompaniment parameters each of which determines tone color of said accompaniment tone and corresponds to one of said classification types, the tone colors of said melody tone and said accompaniment tone corresponding to same classification type being different;

said switch means providing an output commonly to both said melody tone forming means and said melody preset device and said accompaniment tone forming means and said accompaniment preset device;

the melody tone color formed by said melody tone forming means being modified in accordance with the classification type selected by said switch means among said melody preset parameters;

the accompaniment tone color formed by said accompaniment tone forming means being modified in accordance with the classification type selected by said switch means among said accompaniment preset parameters.

18. An electronic musical instrument according to claim 17 further including a device for performing an auto-accompaniment suitable for being combined with said selected preset parameters.

19. An electronic musical instrument according to claim 18 wherein said auto-accompaniment is selected from an auto-rhythm an auto-bass/chord and an auto-arpeggio.

20. An electronic musical instrument comprising:

keyboard means including a plurality of keyboards each having a plurality of keys;

a plurality of tone signal generating means each coupled to a different one of said plurality of keyboards for generating a plurality of groups of tone signals, each tone signal to said groups having a pitch corresponding to a depressed one of said plurality of keys of the associated keyboard, said tone signals having different tone colors;

genre designating means for designating one of a plurality of different classification types to which a music to be performed belongs;

a plurality of mixing means each coupled to a different one of said plurality of tone signal generating means and said genre designating means for mixing said tone signals in the mixing ratio determined by the designated one of said classification types, said mixing ratio being preset so as to produce a tone suitable for each of said classification types; and tone producing means coupled to said mixing means for producing a tone corresponding to said mixed tone signals.

* * * * *